C630B OR 4,569,749

United States Patent [19]

Wright

[11] Patent Number: 4,569,749

[45] Date of Patent: Feb. 11, 1986

[54] COAL LIQUEFACTION PROCESS

[75] Inventor: Charles H. Wright, Overland Park, Kans.

[73] Assignees: Gulf Research & Development Company, Pittsburgh, Pa.; Mitsui SRC Development Co., Ltd., Tokyo, Japan; Ruhrkohle AG, Fed. Rep. of Germany; a part interest

[21] Appl. No.: 642,579

[22] Filed: Aug. 20, 1984

[51] Int. Cl.[4] ..... C10G 1/06; C10G 1/00

[52] U.S. Cl. ..... 208/10; 208/8 LE

[58] Field of Search ..... 208/8 LE, 10

[56] References Cited

U.S. PATENT DOCUMENTS

| | | | |
|---|---|---|---|
| 4,045,329 | 8/1977 | Johanson et al. | 208/10 |
| 4,159,237 | 6/1979 | Schmid | 208/10 |
| 4,192,653 | 3/1980 | Giannetti et al. | 208/8 |
| 4,364,817 | 12/1982 | Anderson et al. | 208/8 |
| 4,400,263 | 8/1983 | Kydd et al. | 208/10 |
| 4,473,460 | 9/1984 | Küerten et al. | 208/10 |

OTHER PUBLICATIONS

Anderson, et al., "Improving Coal Liquid Quality by Heavy Distillate Recycle" Presented at Seventh Annual EPRI Contractors' Conference on Coal Liquefaction May 11-13, 1983.

*Primary Examiner*—John Doll
*Assistant Examiner*—William G. Wright
*Attorney, Agent, or Firm*—Buell, Ziesenheim, Beck & Alstadt

[57] ABSTRACT

A process for the liquefaction of coal wherein raw feed coal is dissolved in recycle solvent with a slurry containing recycle coal minerals in the presence of added hydrogen at elevated temperature and pressure. The highest boiling distillable dissolved liquid fraction is obtained from a vacuum distillation zone and is entirely recycled to extinction. Lower boiling distillable dissolved liquid is removed in vapor phase from the dissolver zone and passed without purification and essentially without reduction in pressure to a catalytic hydrogenation zone where it is converted to an essentially colorless liquid product boiling in the transportation fuel range.

46 Claims, 1 Drawing Figure

T208
413
x 208
417
x208
418
x208
428
x208
427

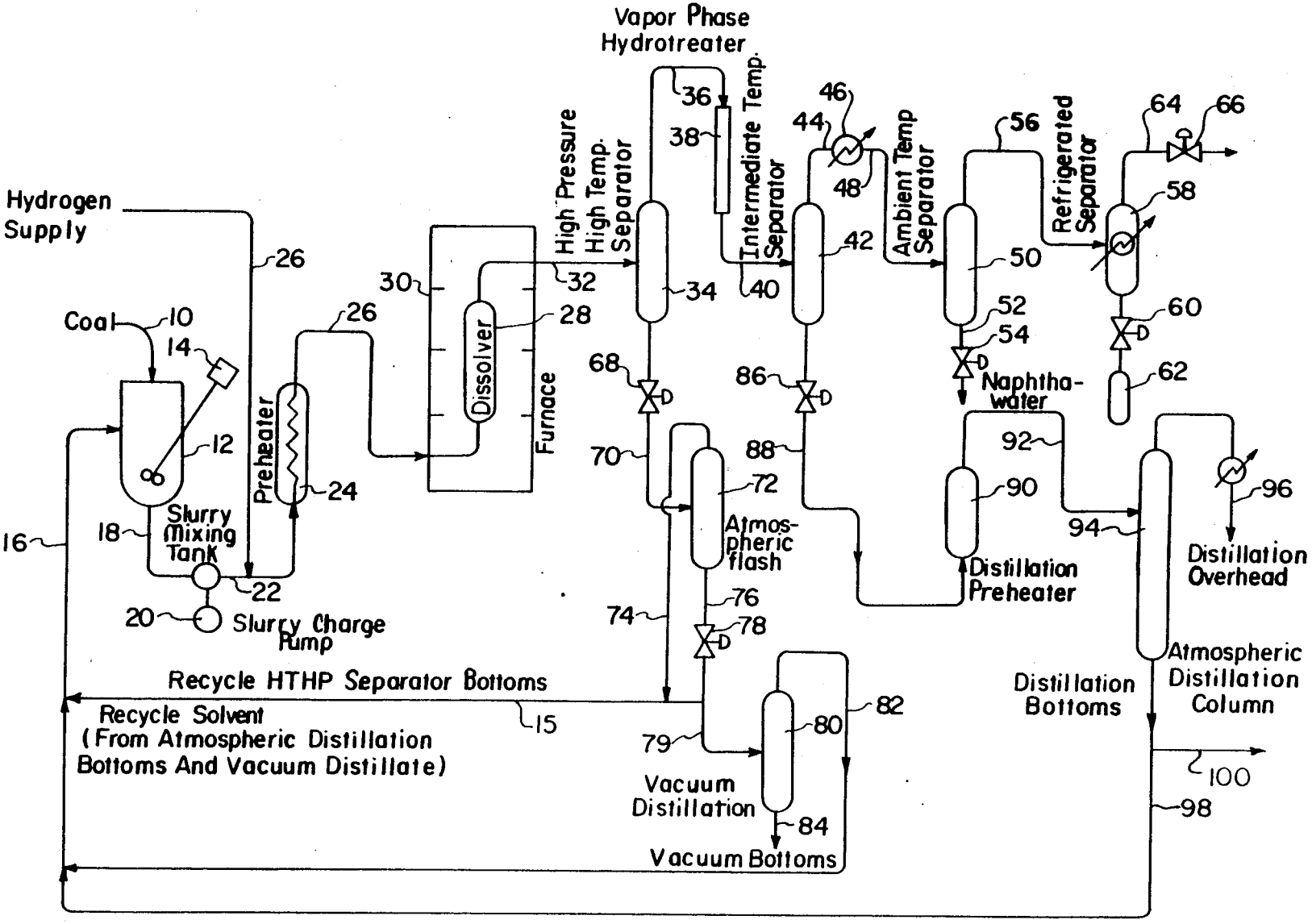
Hydrogen Supply
Coal
Slurry Mixing Tank
Preheater
Slurry Charge Pump
Furnace
Dissolver
High Pressure High Temp. Separator
Vapor Phase Hydrotreater
Intermediate Temp. Separator
Ambient Temp Separator
Refrigerated Separator
Naphtha-water
Distillation Preheater
Atmos-pheric flash
Distillation Overhead
Atmospheric Distillation Column
Distillation Bottoms
Vacuum Distillation
Vacuum Bottoms
Recycle HTHP Separator Bottoms
Recycle Solvent (From Atmospheric Distillation Bottoms And Vacuum Distillate)

COAL LIQUEFACTION PROCESS

The Government of the United States of America has rights in this invention pursuant to Contract No. DE-AC22-82PC50001 awarded by the U.S. Department of Energy to Gulf Research and Development Company.

This invention relates to an improvement in the SCR-II process wherein raw feed coal is converted to deashed coal liquids by dissolving the feed coal in recycle solvent in the presence of recycle minerals and hydrogen under dissolving conditions of temperature and pressure. The SRC-II process is described in U.S. Pat. No. 4,159,238, which is hereby incorporated by reference.

The SRC-II coal liquefaction process can produce the full array of distillate liquid fractions including naphtha, middle distillate and heavy distillate. Much of the product oil is in the heavy distillate fraction and has a very dark coloration. The 700°-900° F. portion of the heavy distillate product oil contains potentially carcinogenic material. In addition, all product oil fractions and the process waste water contain phenols and nitrogen compounds. Phenols are irritating to the skin. The nitrogen compounds in the heavy distillate are noxious. Nitrogen compounds in the transportation fuel boiling range fractions produce $NO_x$ gases during use. High nitrogen levels in naphtha fractions interfere with naphtha reforming. The presence of nitrogen compounds and phenols in process waste water require expensive purification steps prior to water disposal.

It is a purpose of the present invention to destroy the heavy distillate product oil or at least substantially the entire 700° F.+ portion having potentially carcinogenic properties. It is also a purpose of the present invention to destroy the components in the lighter oils and in the waste water having toxic and biologically active characteristics, such as phenols and cresols and nitrogen-containing compounds such as aniline, pyridine, quinoline, carbazole, etc. Destruction of these compounds in the waste water stream permits the waste water stream to be safely discarded with minimum purification.

The present process has the capability of destroying the potentially carcinogenic fraction and of substantially reducing the level of phenols and cresols and nitrogen impurity compounds in the remaining product fractions and in the waste water. In addition, the present process can produce a white oil product which is relatively color stable and which can retain its colorless condition indefintely or over many months of storage.

Although it is an important feature of the present invention that the entire 700° F.+ heavy distillate oil is essentially eliminated as a product of the process, thereby eliminating the potentially carcinogenic component of the oil product, the present invention can conveniently practically or substantially entirely eliminate oils boiling above about 550°, 570°, 590° or 600° F., or any other convenient cut point, in favor of lower boiling more valuable oils.

The present invention can provide an oil product which is primarily or entirely in the transportation fuel range, including the naphtha, jet fuel and diesel oil boiling ranges. Diesel oil, the highest boiling of these fractions, boils up to about 590° F. The present invention employs a combination of process steps which involves synergism or interdependence for the elimination of phenols and nitrogen compounds. The present invention particularly destroys phenols in the middle distillate fraction by converting phenolic groups to water. The destruction of phenols in the middle distillate fraction in this manner reduces the boiling point of these components of middle distillate oils and advantageously converts them to materials in the naphtha range without resorting to hydrocracking.

An important feature of this invention is that the naphtha and other transportation fuel boiling range product fractions are low in nitrogen. For example, the naphtha range fraction can have a nitrogen level of less than 1 or 2 parts per million, making it highly suitable for upgrading via reforming to a valuable gasoline product. It is remarkable to achieve a coal-derived naphtha fraction having such a low nitrogen content since naphtha and higher boiling distillate fractions of the prior art process commonly contained 1600 and 7700 parts per million of nitrogen, respectively.

According to the present process, a slurry comprising a mixture of pulverized feed coal, recycle distillate solvent oil and a recycle slurry comprising coal minerals in non-distillable dissolved coal in a mixing tank is pumped to process pressure and mixed with hydrogen. The mixture is heated in a relatively short residence time preheater and passed to a longer residence time liquefaction vessel where it remains under elevated temperature and pressure conditions. In the liquefaction zone, the hydrocarbonaceous material in the raw coal is depolymerized and hydrocracked and becomes released from coal minerals. The feed coal is converted into distillable coal liquids and non-distillable pyridine soluble coal liquid. The heavier non-distillable coal liquid is removed from the liquefaction zone in slurry with the removed minerals.

The entire contents of the dissolver, i.e. the liquefaction zone, are discharged without essentially any reduction in pressure, without addition or removal of any material and without intermediate storage to a high temperature-high pressure (HTHP) separator. The HTHP separator is maintained essentially at dissolver pressure. The stream flowing to the HTHP separator is cooled to a temperature which determines the cut point of the separation to occur in the HTHP separator. A vapor phase fraction is taken overhead from the HTHP separator and comprises naphtha and higher and lower hydrocarbons together with hydrogen, hydrogen sulfide, ammonia, $CO_x$ and water vapor. A liquid phase bottoms fraction is removed from the HTHP separator through a pressure reducing valve and passed to an atmospheric separator.

At the atmospheric separator, an atmospheric distillate fraction is taken overhead and is recycled as solvent to the feed coal slurry mixing tank while the atmospheric separator bottoms is in part recycled to the feed coal slurry mixing tank while the remainder is passed through a valve to a vacuum distillation zone. A vacuum distillate and a vacuum bottoms are separately removed from the vacuum distillation zone. The vacuum bottoms comprises a slurry of non-distillable dissolved coal, insoluble organic matter and coal minerals and can be passed to a partial oxidation zone for conversion to process hydrogen.

The vacuum distillate generally comprises a fraction most of which boils in the range 500° to 900° F. Coal oils boiling above 700° F. have been found to be mutagenic in the Ames test and, therefore, the vacuum distillate fraction boiling in the 700° to 900° F. range contains potentially carcinogenic materials. Furthermore, the vacuum distillate has the darkest coloration of any product oil fraction. It is a particular feature of this invention that essentially the entire vacuum distillate or the entire highest boiling fraction thereof (e.g. the 590° F.+, the 600° F.+ or the 700° F.+ distillate oil of the process) is recycled to the dissolver zone where it is cracked to extinction. In this manner, the mutagens of the oil product are destroyed as well as the darkest color components of the oil product.

Data presented below show that the relatively long residence time liquefaction reactor zone is capable of cracking recycled vacuum distillate boiling up to 900° F., or higher, to lower boiling point heavy distillate or to middle distillate oil boiling in the range 380° to 550° F., but essentially not to naphtha boiling in the $C_5$ to 380° F. range. However, in accordance with this invention, a large yield of middle distillate is avoided in favor of an enhanced naphtha yield by continuously passing substantially the entire dissolver effluent vapor stream (the HTHP overhead) without intermediate holdup and under essentially undiminished dissolver pressure to a catalytic hydrogenation zone. There is no addition or removal of any components to the HTHP overhead vapor stream in its passage to the catalytic hydrotreater.

The catalyst in the hydrogenation zone can comprise Group VI and Group VIII metals on a non-cracking support, such as alumina. The HTHP vapor stream passed to the hydrotreater contains the ammonia, hydrogen sulfide, carbon monoxide and carbon dioxide ($CO_x$) and water vapor present in the dissolver which were formed from the nitrogen, sulfur and oxygen in the feed coal and from water present in the feed coal. Although these materials reduce hydrogen partial pressure, the reduction in hydrogen partial pressure due to these contaminants is not particularly detrimental.

Suitable hydrotreater catalyst compositions include cobalt-molybdenum, nickel-molybdenum or nickel-cobalt-molybdenum on a non-cracking support. A preferred catalyst comprises nickel-molybdenum on alumina. The catalyst hydrogenates and thereby removes heteroatoms such as nitrogen, sulfur and oxygen. It is capable of reducing boiling point without hydrocracking by converting the hydroxyl radical of phenols to water. The recycle to extinction of the highly phenolic heavy distillate oils converts these oils to highly phenolic middle distillate oils. Therefore, the 380° to 550° F. middle distillate fraction is very rich in phenols. Because of its capability of converting phenolic hydroxyl groups to water without hydrocracking, the hydrogenation catalyst converts middle distillate boiling range coal oils to naphtha ($C_5$ to 380° F.) with very little production of $C_1$ to $C_4$ gases. If boiling range reduction occurred via hydrocracking, instead of hydrogenation of hydroxyl groups, there would be a considerable enhancement of $C_1$ to $C_4$ gas yield and a corresponding increase in hydrogen consumption.

The absence of a storage step for the HTHP vapor stream between the dissolver and the catalytic hydrotreater tends to avoid discoloration of oils in this stream. In general, storage and aging induce discoloration in an unstable (non-hydrotreated) oil due to oxidation and gum formation. These are known to affect catalytic hydrogenation adversely. Thereby, the absence of storage contributes to production of a water white hydrotreated product.

The absence of a storage step, the avoidance of significant pressure reduction between the HTHP separator and the hydrotreater and the non-addition or removal of any component effectively combines the liquefaction zone and the hydrotreater zone into a highly integrated and unitized operation, except that the hydrotreater zone receives only the vapor phase material from the liquefaction zone. Since the hydrotreater zone is provided with a packed or fixed catalyst bed, it operates at a temperature lower than the temperature of the liquefaction zone, which does not have a packed or fixed catalyst bed.

Many prior art coal liquefaction processes employ a liquefaction zone and a fixed or mobile bed catalyst zone in series. However, in those processes the full range product from the liquefaction zone, including the heavy distillate and non-distillable coal product, is passed to the catalytic hydrogenation zone. Unlike the present invention, hydrocracking must take place in the second stage of these prior art processes. The heavy oils are difficult to hydrotreat, contribute to rapid catalyst deactivation and are difficult to deoxygenate and denitrogenate. In contrast, according to the present invention the catalyst is not exposed to non-distillable coal products or high boiling heavy distillates so that the hydrotreater catalyst is protected from them and accorded a longer active life. The recycle to extinction converts these heavy distillates to middle distillates, which are more easily catalytically hydrotreatable oils whose heteroatoms and phenolic groups are less refractory to removal by hydrogenation than the same heteroatoms and phenolic groups in heavy distillates.

Therefore, the hydrotreater catalyst is protected from the entire portion of distillate oils boiling above about 590° or 600° F., or other convenient cut point. The middle distillate oils that reach the hydrotreater tend to easily lose phenolic groups and thereby tend to be reduced to naphtha boiling range materials. Sulfur, nitrogen and oxygen all tend to be hydrogenated and converted to hydrogen sulfide, ammonia and water, respectively, thereby removing toxic materials and color bodies from product oil and waste water. A waste water product is recovered substantially free of dissolved organic matter which can be disposed of safely with less expensive after treatment.

The hydrocarbon product recovered tends to be colorless. If some higher boiling components are present in the hydrotreated product by being carried to the hydrotreater in the HTHP vapors due to ineffective separation in the HTHP separator, the high boiling materials can impart color to the hydrotreater product, especially after lengthy storage. In such case, the hydrotreater product can be distilled and the highest boiling hydrotreated fraction can be recycled to the dissolver zone to extinction.

The naphtha fraction of the product is particularly low in nitrogen and can have less than one or two parts per million of nitrogen. The naphtha fraction is of sufficiently high quality to qualify as a charge stock for a reformer, including a reformer pretreating zone, for upgrading to gasoline. The high level of elimination of oxygen and nitrogen from the oil in the hydrotreater accounts for the clear white coloration of the hydrotreated oil.

The recycle to extinction of the heavy oil fraction (590° to 900° F.) is highly interdependent with respect to the catalytic hydrogenative upgrading of the entire remaining distillate. Since it is an objective of the present process to produce a water white oil product, the catalytic hydrogenation required to accomplish this objective would be considerably more difficult to achieve if the heavy oils were passed to the catalytic hydrotreater zone. As mentioned earlier, it has been the practice of prior art processes which employ downstream catalytic upgrading of coal liquids to pass the full range liquid stream, including the heaviest oils, from the liquefaction zone to the catalytic hydrogenation zone. The heavy oils are considerably more difficult to upgrade catalytically than the vapor phase oils in that they require a longer residence time in the hydrotreater and substantially reduce catalyst life as compared to the vapor phase oils. On the other hand, the recycle to extinction of 590° F.+ heavy distillate in the liquefaction zone converts the heavy distillate to middle distillate oils. Data presented below show that this conversion occurs with very little additional hydrogen consumption or increased yield of $C_1$ to $C_4$ gases. Thereby, at low incremental hydrogen cost and with minimal loss of yield the recycle to extinction step converts a material which is deleterious to the hydrotreater catalyst to a lower boiling material which the hydrotreater catalyst is capable of upgrading in a facile manner.

It is seen that the recycle to extinction of heavy oil in the liquefaction zone provides a mechanism for forcing a relatively low molecular weight feed to the hydrotreater. The mechanism allows the liquefaction zone and the hydrotreater zone each to operate at its own highest efficiency. The relatively high temperature long residence time liquefaction zone without a fixed bed of hydrogenation catalyst is most efficient in hydrocracking heavy coal molecules, but is not highly efficient for removing impurity atoms, such as oxygen and nitrogen. On the other hand, the hydrogenation zone, which is packed with a fixed bed of hydrogenation catalyst, is not primarily a cracking zone, but is relatively more efficient in hydrogenating heteroatoms and phenols and in reducing molecular weight via hydrogenation rather than hydrocracking.

An extremely important interdependent feature connecting recycle to extinction of heavy oils and catalytic hydrotreating of the remaining lighter oils is that the recycle to extinction step converts the heavier fraction having the most refractory heteroatoms and phenolic groups into a lighter fraction in which the same heteroatoms and phenolic groups are less refractory. It is shown below (Table 1A) that the combination of these two steps can reduce the sulfur content in the total distillate oil product from 3,700 to 230 parts per million by weight; can reduce the nitrogen content in the total distillate oil product from 7,600 to 0.5 parts per million in weight; and can reduce the oxygen content in the total distillate oil product from 30,000 to 100 parts per million by weight. It is further shown below (Table I) that these remarkably low heteroatom levels in the total distillate oil product are achieved with only a relatively insignificant increase in $C_1$–$C_4$ gas yield from 11.4 to 11.9 weight percent and with only a relatively insignificant decrease in total oil yield from 43.0 to 41.1 weight percent. The improved results were advantageously accomplished with a lower boiling total distillate oil product than the comparison process.

A central feature of this invention is the recognition that the hydrotreater can efficiently handle a crude vapor stream without storage and repressurizing and without removal of contaminants from the vapor stream which reduce the hydrogen partial pressure and which have been known to poison a hydrogenation catalyst. If desired, essentially the only oil product of the process is derived from the hydrotreater with essentially no non-hydrotreater oil stream blended therewith. In this manner, all coal liquids produced in the dissolver are converted to high grade catalytically hydrogenated oil products boiling below about 600° F., depending upon the cut point of the fraction recycled to extinction.

It has been found that a difficulty can be experienced in operating the hydrotreater when the process employs feed coals containing chlorine, whose ash was without sufficient basic components. In this case, ammonium chloride was found to deposit out in the relatively low temperature regions of the hydrotreater, or at the hydrotreater exit. This problem was associated with Eastern coals, but not with Western coals, and was solved by adding a neutralizing material for the chloride, such as sodium carbonate. The addition of sodium carbonate succeeded in eliminating ammonium chloride deposits.

While is it a primary purpose of the present invention to recycle to extinction all heavy distillate in advance of the hydrotreater, it was noted above that some of these materials can find their way into the HTHP separator vapor overhead stream and then into the hydrotreater. They are evidenced by a discoloration of the hydrotreater oil on aging, sometimes after several months of aging. In accordance with this invention, these materials can be separated from hydrotreated oil and recycled to the liquefaction zone. Therefore, this invention involves recycle to extinction of high boiling oil products both before and after the hydrotreater zone. However, it is preferable that all such high boiling oils are recycled in advance of the hydrotreater in order to protect the hydrotreater catalyst and to conserve hydrogen.

As stated above, the hydrotreated naphtha has a sufficiently low nitrogen level that is suitable for upgrading to gasoline by reforming. In this case, the hydrogen produced by the reformer can be utilized in the hydrotreater. This provides further interdependence in the present process.

It is noted that recycle mineral residue performs a catalytic function in the dissolver zone. In addition, to the minerals in the feed coal, including pyrite, pyrite from an external source, or any material which forms pyrrhotite or iron sulfide in the liquefaction zone, can be added to the liquefaction zone as a catalytic entity. Recycle minerals or pyrite or a material which forms pyrrhotite or iron sulfide from an external source are low cost, generally naturally occurring disposable circulating catalysts. In contrast, the hydrotreater employs a catalyst in a fixed or mobile bed which is not a simple naturally occurring material, but is a commercially prepared catalyst composition.

The success of the hydrotreater of this invention is particularly remarkable when treating subbituminous coals or lignite. These feed coals are generally liquefied with naturally occurring bed moisture and are only partly dried. Furthermore, these feed coals generally require added pyrite in the liquefaction step. The hydrotreater performs in a highly satisfactory manner with these feed coals without preremoval of water vapor. Bituminous coals can be mined with a relatively lower water content or can be easily dried. Furthermore, bituminous coal generally does not require pyrite addition.

It has been found that the phenols and the nitrogen compound impurities tend to equilibrate between the oil phase and the water phase in the system. In the oil phase, they tend to act as color-formers. In both phases, they tend to be noxious. Because of the purification occurring in the hydrotreater, the water phase product of the present process will generally include only ammonia, hydrogen sulfide and carbonates. The recovery of these materials can be commercially advantageous. In contrast, the toxic materials which are destroyed in the hydrotreater are not particularly commercially valuable.

It is notable that under the temperature and pressure used about 20 to 30 volumes of gas plus vapor flow through the liquefaction zone for each volume of liquid. The gases include primarily hydrogen, hydrocarbons and water vapor. These gases tend to have a much shorter residence time in the liquefaction zone, as compared to the residence time of heavy liquefaction products. Therefore, the gaseous phase is less amenable to treatment in the liquefaction zone for removal of noxious materials than is the liquid phase. Use of the hydrotreater to accept the gaseous phase involves the insertion of only one vessel into the system. No recompression is required. This illustrates the specialized interdependence between use of a hydrotreater for vapor phase upgrading versus use of the liquefaction zone for liquid phase upgrading.

Suitable conditions in the liquefaction zone include a temperature in the range of about 700° to about 900° F. (371° to 482° C.), preferably about 750° to about 870° F. (400° to 466° C.) and a residence time of about 0.1 to about 4 hours, preferably about 0.2 to about 2 hours. The pressure is in the range of about 1,000 to about 4,000 psi and is preferably about 1,500 to about 3,000 psi (70 to 280 kg/cm$^2$, preferably 150 to 210 kg/cm$^2$).

Suitable conditions in the catalytic hydrotreater zone include a temperature in the range about 500° F. to about 800° F., preferably about 600° F. to about 750° F. The liquid hourly space velocity can be about 0.1 to about 3, preferably 0.5 to about 2, hr$^{-1}$. The pressure is liquefaction zone pressure.

The hydrotreater induces only a small change in total oil yield due to heteroatom removal. The hydrotreater performs very little hydrocracking and produces very little hydrocarbon gases. It consumes hydrogen via heteroatom or hydroxy group removal by the formation of ammonia, hydrogen sulfide and water. However, the greater part of the hydrogen is consumed by an increase in the hydrogen content of distillate products.

The attached figure illustrates a flow scheme for the process of his invention. A stream 10 of pulverized feed coal is charged to slurry mixing tank 12 provided with a stirrer 14. A recycle stream containing a slurry comprising high boiling liquefied coal and coal minerals from line 15 together with recycle vacuum distillate from line 82 is charged to slurry mixing tank 12 through line 16. The mixture in tank 12 can comprise about 30 weight percent feed coal, about 5 to 12 weight percent recycle distillate with the remainder being the recycle slurry of liquefied coal and coal minerals. Pyrites can also be added to tank 10 to serve as a liquefaction catalyst, if required.

The slurry mixture is passed through line 18, positive displacement pump 20 and line 22 to preheater 24. Recycle and make-up hydrogen at process pressure is charged to line 22 through line 26. The mixture of feed coal, recycle slurry, recycle vacuum distillate and hydrogen is passed through a coil in a relatively short residence time fired preheater 24 where it is preheated before passage through line 26 to liquefaction vessel 28 which is disposed within furnace 30. Vessel 28 is maintained at a temperature of 700°-900° F.

Liquefaction vessel 28 is maintained at a relatively high temperature and pressure and the stream remains within vessel 28 for a relatively long residence time. The feed coal undergoes depolymerization and hydrocracking within vessel 28 and then is discharged through line 32 having cooling means, not shown, to high pressure-high temperature separator 34. A vapor phase is separated from a liquid phase in separator 34. The vapor phase is withdrawn overhead through line 36 and passed downwardly (or upwardly) through a packed or mobile bed catalytic hydrotreater 38 without any hold-up, repressurizing or material addition or removal steps.

Hydrotreater 38 contains a Group VI-Group VIII metal catalyst, such as nickel-molybdenum, cobalt-molybdenum or nickel-cobalt-molybdenum on a non-cracking support, such as alumina. In hydrotreater 38 noxious compounds, including nitrogen compounds and phenols, are destroyed to produce a water white hydrotreated oil product.

An effluent stream is removed from hydrotreater 38 through line 40 and passed to an intermediate temperature separator 42. Liquid is separated from vapor in separator 42 and a vapor stream is taken overhead through line 44, cooler 46 and line 48 from which it enters ambient temperature separator 50. A naphtha-water mixture is separated from a vapor stream in separator 50. The naphtha-water mixture is removed from the system through line 52 and valve 54. A vapor stream passes through line 56 to refrigerated separator 58 from which a pressurized liquid, including $C_3$ and $C_4$ hydrocarbons, is passed through valve 60 to a pressure container 62 while a product vapor ($C_1$-$C_2$, $H_2S$, $NH_3$, $CO_x$) is removed overhead through line 64 and valve 66, whence it is removed as product.

The liquid slurry bottoms from high temperature-high pressure separator 34 is passed through valve 68 and line 70 to atmospheric flash chamber 72. In flash chamber 72, light liquid distillate is flashed overhead and passed to recycle through lines 74, 15 and 16 while a liquid slurry bottoms is removed through line 76 and valve 78 and passed through line 79 to vacuum distillation column 80. Vacuum distillation column 80 can be operated at 270° C. and 2 mm pressure.

In vacuum distillation column 80, a vacuum distillate is removed overhead through line 82 and is recycled. It is a particular feature of this invention that the vacuum distillate in line 82 is essentially recycled to extinction by return to line 16. This heavy distillate includes oils boiling in the 590° to 900° F. range. The 700° to 900° F. portion of this faction is potentially carcinogenic. This fraction contains polycyclic fused aromatic-type ring compounds containing heteroatoms. This fraction contains toxic materials such as phenols, quinolines, carbazoles, acridine, benzoquinolines and other similar organic nitrogen compounds.

The bottoms from vacuum distillation column 80 is removed through line 84 and contains non-distillable coal product which is solid at room temperature plus ash from the feed coal plus insoluble organic matter. The material in line 84 may be passed to a partial oxidation gasifier, not shown, for conversion to hydrogen. Such gasifiers are well-known and the carbonaceous material in line 84 can be gasified to supply hydrogen for the process.

The bottoms from intermediate separator 42 is removed through valve 86 and line 88 and passed to distillation preheater 90 and finally through line 92 to atmospheric distillation column 94. A distillation overhead stream containing naphtha and middle distillate which is water white is removed through line 96 while a distillation bottoms stream comprising a relatively small amount of heavy distillate, if any, is removed through line 98. The stream in line 98 contains actual or potential (on standing) color bodies and gum formers and can be recycled to extinction by return to line 16. Should this not be desired, a hydrotreated product may be removed via line 100.

Data illustrating the invention are presented in Table I.

TABLE I

| | Test 1 | Test 2 | Test 3 |
|---|---|---|---|
| Conditions | | | |
| Operating Mode | SRC II with recycle to extinction of all 310° C. + (590° F. +) distillate | Conventional SRC II | SRC II with vapor phase hydrotreater and recycle to extinction of vacuum distillate and one-third of hydrotreater bottoms |
| Coal | | Powhatan No. 6 Bituminous | |
| Nominal Slurry Residence Time, hr | 1.01 | 1.01 | 1.03 |
| Coal Feed Rate, lb/hr/ft$^3$ | 21.0 | 21.2 | 20.7 |
| Coal | 30.0 | 30.0 | 30.0 |
| HTHP[a] Bottoms | 64.0 | 63.0 | 61.0 |
| Recycled Solvent | 6.0 | 7.0 | 8.2 |
| Additive | — | — | 0.8 |
| Additive | — | — | $Na_2CO_3$ Emulsion |
| Addition Rate, wt % $Na_2CO_3$, based on coal | — | — | 0.28 |
| Hydrogen Feed Rate | | | |
| wt %, based on slurry | 4.02 | 4.01 | 4.16 |
| MSCF/ton of coal | 51.3 | 51.0 | 52.4 |
| Average Dissolver Temp. | | | |
| °C. | 450 | 449 | 450 |
| °F. | 842 | 840 | 842 |
| Pressure, psig | | 2250 | |
| Yields, wt %[b] | | | |
| $H_2O$ | 5.0 | 5.9 | 6.3 |
| $CO + CO_2$ | 1.2 | 1.2 | 0.8 |
| $H_2S$ | 3.0 | 3.0 | 3.2 |
| $NH_3$ | 0.4 | 0.5 | 0.9 |
| Total $C_1$-$C_4$ | 11.0 | 11.4 | 11.9 |
| Naptha, $C_5$-193° C. (380° F.) | 15.1 | 14.2 | 19.6 |
| Middle Distillate 198-288° C. (380-550° F.) | 22.7 | 13.8 | 14.9 |
| Heavy Distillate (above 288° C. (550° F.) | 1.8 (550 to about 590° F. only) | 15.0 | 6.6 |
| Total Oil ($C_5$-Heavy Distillate) | 44.1 ($C_5$-about 590° F. only) | 43.0 | 41.1 |
| Non-distillable coal liquid | 26.0 | 25.7 | 28.0 |
| Insoluble Organic Matter | 4.2 | 4.4 | 4.4 |
| Ash | 9.8 | 9.5 | 9.7 |
| Total | 104.7 | 104.6 | 106.3 |
| Hydrogen Consumed | | | |
| (by gas balance) | 4.7 | 4.6 | 6.3 |
| (by elemental balance) | 4.1 | 3.8 | 5.1 |
| Catalyst Conversion | — | — | — |
| Byproducts | | | |
| Product Analyses | | | |
| Naphtha | | | |
| % C | 84.96 | 84.60 | 86.12 |
| % H | 12.52 | 12.50 | 13.44 |
| % S | 0.23 | 0.30 | 0.17 |
| % N | 0.16 | 0.16 | 0.00 |
| % O (by difference) | 2.13 | 2.44 | 100 ppm (by measurement) |
| Middle Distillate | | | |
| % C | 85.69 | 84.91 | 87.92 |
| % H | 9.72 | 9.14 | 11.23 |
| % S | 0.25 | 0.27 | 0.04 |
| % N | 0.96 | 0.94 | 0.00 |
| % O (by difference) | 3.38 | 4.74 | 0.81 |
| Heavy Distillate | | | |
| % C | 87.50 | 88.69 | 88.02 |
| % H | 8.55 | 7.67 | 11.43 |
| % S | 0.49 | 0.54 | 0.41 |
| % N | 1.05 | 1.16 | 0.00 |
| % O (by difference | 2.41 | 1.94 | 0.14 |
| Distillate Residue | | | |
| % C | 65.87 | 65.98 | 66.53 |
| % H | 3.99 | 4.06 | 4.14 |

TABLE I-continued

| | Test 1 | Test 2 | Test 3 |
|---|---|---|---|
| % S | 3.61 | 3.66 | 3.77 |
| % N | 1.28 | 1.31 | 1.36 |
| % Ash | 25.27 | 25.36 | 23.90 |
| Fusion Point, °C. | 91 | 104 | 101 |

[a]High temperature high pressure separator
[b]MF coal basis

Table I presents the results of three tests involving reaction of Powhatan No. 6 seam bituminous coal. Vacuum distillate was recycled in all three tests but in each case the handling differed. In Test 1 the vacuum distillate was recycled essentially to extinction. Test 2 is the base test and shows results obtained with conventional operating procedures in the SRC-II process in which heavy distillate is not recycled to extinction, but in which a part is recycled and a part is taken as product. Test 3 shows the effect of integrating the vapor phase hydrotreater. In this case the vacuum distillate was all recycled (see vessel 80 and line 82) and a portion of the hydrotreated oil from the atmospheric distillate bottoms (see vessel 94 and line 98) was returned to recycle as well. These data illustrate techniques in which the composition of the recycle feed can be managed to force the production of lighter oils and in which integration of the hydrotreater modifies the product distribution by hydrogenating the oils generated in the liquefaction step.

Test 1 of Table I differs from base Test 2 in that all 310° C.+ (590° F.+) distillate is recycled to extinction. Comparing Test 1 with Test 2, it is seen that the recycle to extinction reduced the 550° F.+ heavy distillate yield from 15.0 to 1.8%. (all of which is in the 550° to 590° F. boiling range). Nearly all the heavy distillate was converted to middle distillate, since the naphtha yields in Tests 1 and 2 are about the same. It is remarkable that a more valuable, lower boiling oil was achieved in Test 1 versus Test 2 with essentially unchanged yield of $C_1$ to $C_4$ gases and with essentially unchanged hydrogen consumption.

It is noted that the essential destruction of the heavy distillate fraction removed all of the 700° to 900° F. potentially carcinogenic materials from the system.

Test 3 differs from Test 1 and 2 in that a vapor phase hydrotreater was used. Here, a recycle technique as follows was used to generate a vapor phase feed for the hydrotreater. The hydrotreater operated on the vapor and gas separated and flowing overhead from the high pressure high temperature separator (see vessel 34 and line 36). The heavy oil was recycled to consume all of the vacuum distillate oil (see vessel 80 and line 82) and one-third of the hydrotreated product from the atmospheric distillation bottoms (see vessel 94 and line 98) was returned to maintain the required amount of oil in the slurry feed while two-thirds of the bottoms was removed as hydrotreated product (see line 100).

The hydrotreater catalyst used in all of the hydrotreater tests presented herein comprised nickel-molybdenum-alumina. Comparing Test 3 with base Test 2, it is seen that there is a marked increase in yield of naphtha, which is the most valuable liquid product. This increase in naphtha yield comes entirely at the expense of the less valuable heavy distillate fraction, rather than from the more valuable middle distillate fraction since the middle distillate yields in Test 2 and 3 are about the same. Surprisingly, the increase in naphtha yield induced no significant increase in yield of $C_1$ to $C_4$ gases and no significant decrease in yield of total distillate oil. This shows that continuous removal of vapor fraction from the coal conversion process is not only beneficial in regard to naphtha production, but that the additional hydrotreating may be accomplished with very little undesirable hydrocracking to lighter gases and with very little decrease in yield of total distillate oil.

Comparing Test 1 with Test 2, it is seen that the recycle mode of Test 1 is most beneficial in regard to upgrading the heavy distillate fraction. This upgrading is primarily only to middle distillate, but it occurs with essentially no penalty in regard to hydrogen consumption and $C_1$ to $C_4$ gas yield. On the other hand, in Test 3 heavy distillate is upgraded, and all lighter oils produced are further upgraded by the hydrotreater, but this requires an expenditure of hydrogen.

It will be appreciated that the recycle to extinction mode of Test 1 can be combined with the vapor phase hydrotreating mode of Test 3 with considerable interdependence between the two modes. The recycle mode of Test 1 can accomplish a portion of the required upgrading, but without a large cost in hydrogen, thereby relieving the vapor phase hydrotreating mode of Test 3 of a portion of its upgrading burden and thereby conserving a portion of its hydrogen expenditure. In passing through the vapor phase hydrotreating reactor the heteroatoms are essentially eliminated and most of the aromaticity of the product is also eliminated. This lowers the boiling range of the vapor phase product on the average but does not completely eliminate small fractions of heavy oil which are part of the feed to the vapor phase reactor in proportion to the partial pressure of such oils in the overhead stream from the high pressure high temperature separator. If desired this heavy fraction of the hydrotreated product can be collected by distilling the product and returning that part which is to be eliminated, or by returning that part required to balance the process or control the viscosity of the feed slurry.

It is again noted that in Test 3, one-third of the hydrotreated oil obtained as bottoms in the atmospheric distillation (see vessel 94 and line 98) was returned to the feed while two-thirds of this material was removed as product (see line 100) for blending with other hydrotreated products as removed at lines 54 and 96. It is further noted that the concentration of materials in the feed slurry can be managed to force conversion of any fraction which is within the boiling range suitable for formulation into the feed, if that fraction is taken from the product array and systematically returned to the feed. During storage, tendency to discolor and to form gum has been correlated with the presence of traces of the highest boiling and least hydrotreated substances in the hydrotreater product, and these are accumulated in the bottoms from vessel 94. As a consequence, the formulation procedures were modified in a subsequent test to take better advantage of this operation. The comparison of the heavy oil yield in Test 1 and Test 3 shows how these formulations strategies alter the product yield. In Test 1 the oil is untreated and retains significant amounts of heteroatoms. On the other hand, the oil in Test 3 is hydrotreated and contains only traces of residual heteroatoms. These traces, however, may make the oil undesirable for some applications and acceptable for others. In all cases, nitrogen removal from the hydrotreated products is very good.

It is noted that sodium carbonate was added to the hydrotreater mode of Test 3. The reason is that bituminous coals may contain chloride, without adequate alkaline components, such as sodium, which allows ammonium chloride to form and sublime into the vapor phase hydrotreater, which is still cooler than the dissolver zone and the high pressure high temperature separator. Ammonium chloride may thus plug the vapor phase reactor at a cool spot, particularly at the exit end of the reactor. Alkalis, such as sodium carbonate or potassium carbonate or any convenient substitute capable of reacting with the chlorine, will prevent such deposit formation by retaining the chlorine as a component of the high pressure high temperature separator bottoms. Generally, ammonium chloride deposits are not a problem with coals of lower rank than bituminous coals since they tend to have an alkaline ash, specifically an exchangeable sodium ash. The need for an additive may be deduced by observation of the proportions of chlorine and alkaline materials as shown by analysis of the coal.

It is highly significant to the present invention to observe that in coal oils heteroatom sulfur, nitrogen and oxygen and phenolic groups are not only more heavily concentrated in higher boiling oil fractions than in lower boiling oil fractions, but also the heteroatom sulfur, nitrogen and phenolic groups in the higher boiling oil fractions are more refractory than in the lower boiling oil fractions. Therefore, the step of recycle to extinction of the higher boiling oil fraction is highly interdependent with respect to the catalytic hydrotreating step because the recycle to extinction step destroys the heavier fraction having the most refractory heteroatoms, providing a lighter and therefore less refractory heteroatom feedstock for the hydrotreater.

The extent of this interdependent effect is sharply illustrated in Table IA, which is a continuation of Tests 2 and 3 of Table I.

TABLE 1A

| | Test 2 | Test 3 |
|---|---|---|
| Operating Mode | Conventional SRC II | SRC II with vapor phase hydrotreater and recycle to extinction of vacuum distillate and one-third of hydrotreater bottoms |
| Heteroatom Content of Total Distillate Oil Product, ppm by weight | | |
| S | 3,700 | 230 |
| N | 7,600 | 0.5 |
| O | 30,000 | 100 |
| Analysis of Naphtha fraction boiling below 193° C. | | |
| Paraffins | | 18.4 |
| Monocycloparaffins | | 58.0 |
| Dicycloparaffins | | 9.4 |
| Alkylbenzenes | | 11.4 |
| Indanes/Tetralins | | 2.6 |
| Naphthalenes | | 0.3 |
| Total | | 100.0 |

The above data show the remarkable effectiveness of the present invention in providing a distillate oil product having a remarkably low heteroatom sulfur content. The above data also show that the present invention can produce a naphtha fraction product which is essentially entirely heteroatom-free paraffinic hydrocarbon. As shown in Table I, Test 3 accomplished these remarkable results without a significant increase in $C_1$–$C_4$ gas yield (11.9 v. 11.4 weight percent) and without a significant decrease in total distillate oil yield (41.1 v. 43.0 weight percent). Advantageously, these results are accomplished with a total oil yield which is lower boiling than the comparison process.

The process of the present invention can provide a total distillate oil product having a sulfur content of less than 600, 500 or even 400 or 300 parts per million by weight; a nitrogen content of less than 10, 4 or even 3 or 2 parts per million by weight; and an oxygen content of less than 600, 500 or even 300 or 200 parts per million by weight.

TABLE II

| | Test 4 | Test 5 | Test 6 | Test 7 | Test 8 | Test 9 | Test 10 | Test 11 | Test 12 |
|---|---|---|---|---|---|---|---|---|---|
| Conditions | | | | | | | | | |
| Operating Mode | SRC II with Vapor Phase Hydrotreater | | | | | | | | CONVENTIONAL SRC II WITHOUT HYDROGENATION |
| Coal | Belle Ayr Mine (Subbituminous) | | | | | | | | |
| Average Dissolver Temperature, C. | 420 | 420 | 420 | 420 | 421 | 421 | 430 | 440 | 420 |
| (°F.) | (788) | (788) | (788) | (788) | (790) | (790) | (806) | (824) | (788) |
| Nominal Hydrotreater Temperature, °C. | 370 | 355 | 340 | 330 | 370 | 385 | 355 | 355 | — |
| (°F.) | (698) | (671) | (644) | (626) | (698) | (725) | (671) | (671) | — |
| Pressure, psig | | | | | | 2250 | | | |
| Dissolver Nominal Slurry Residence Time, hr | 1.91 | 1.92 | 1.87 | 1.91 | 1.90 | 1.91 | 1.95 | 1.97 | 1.85 |
| LHSV in Hydrotreater, $hr^{-1}$ | 0.5 | | | | | | | | — |
| Slurry Formulation, wt % | | | | | | | | | |
| Coal | | | | | | 30.0 | | | |
| Recycled HTSB[a] | 62.4 | 62.4 | 61.9 | 60.4 | 61.4 | 61.4 | 61.4 | 63.4 | 61.4 |
| Recycled Solvent | 6.0 | 6.0 | 6.5 | 8.0 | 7.0 | 7.0 | 7.0 | 5.0 | 7.0 |
| Additive | | | | | | 1.6 | | | |
| Additive | | | | | | Pyrite | | | |
| Addition Rate, wt % based on coal | | | | | | 4.85 | | | |
| Hydrogen Feed Rate | | | | | | | | | |
| wt %, based on slurry | 3.84 | 3.88 | 3.78 | 3.85 | 3.83 | 3.85 | 3.93 | 3.97 | 3.72 |

TABLE II-continued

| | Test 4 | Test 5 | Test 6 | Test 7 | Test 8 | Test 9 | Test 10 | Test 11 | Test 12 |
|---|---|---|---|---|---|---|---|---|---|
| MSCF/ton of coal | 49.9 | 50.1 | 48.8 | 49.8 | 49.4 | 49.7 | 50.6 | 51.0 | 47.9 |
| Yields, wt % MF Coal Basis | | | | | | | | | |
| $H_2O$ | 12.5 | 12.3 | 11.6 | 11.5 | 12.0 | 13.0 | 13.1 | 13.0 | 8.1 |
| $CO + CO_2$ | 3.8 | 4.3 | 4.8 | 5.3 | 4.5 | 3.7 | 4.9 | 5.0 | 6.2 |
| $H_2S$ | 1.7 | 1.6 | 1.6 | 1.5 | 1.6 | 1.6 | 1.7 | 1.7 | 1.6 |
| $NH_3$ | 0.6 | 0.6 | 0.6 | 0.6 | 0.6 | 0.6 | 0.7 | 0.9 | 0.3 |
| Total $C_1$-$C_4$ | 8.1 | 7.8 | 7.4 | 7.2 | 8.0 | 8.3 | 9.5 | 10.6 | 6.3 |
| Naphtha, $C_5$-193° C. (380° F.) | 19.5 | 19.6 | 18.3 | 18.5 | 19.1 | 20.0 | 21.5 | 22.2 | 15.7 |
| Middle Distillate 193-288° C. (380-550° F.) | 18.1 | 18.0 | 19.0 | 19.6 | 19.1 | 18.6 | 18.4 | 21.2 | 25.1 |
| Heavy Distillate Above 288° C. (550° F.) - (Tests 4-11 include 550-about 590° F. only) | 8.6 | 8.5 | 8.5 | 7.5 | 8.3 | 8.1 | 8.6 | 10.7 | 10.6 |
| Total Oil ($C_5$-Heavy Distillate) | 46.2 | 46.1 | 45.8 | 45.6 | 46.5 | 46.7 | 48.5 | 54.1 | 51.4 |
| Non-distillable coal liquid | 25.6 | 25.2 | 26.0 | 26.0 | 25.5 | 24.8 | 21.5 | 15.5 | 22.7 |
| Insoluble Organic Matter | 2.5 | 2.8 | 2.9 | 2.9 | 2.5 | 2.5 | 1.7 | 1.5 | 2.5 |
| Ash | 7.3 | 7.2 | 6.9 | 7.0 | 7.0 | 7.0 | 7.1 | 7.0 | 7.1 |
| Total | 108.3 | 107.9 | 107.6 | 107.6 | 108.2 | 108.2 | 108.7 | 109.3 | 106.2 |
| Hydrogen Consumed | | | | | | | | | |
| (by gas balance) | 6.6 | 6.2 | 5.9 | 5.8 | 6.4 | 6.5 | 7.0 | 7.6 | 4.5 |
| (by elemental balance) | 6.2 | 5.9 | 5.8 | 5.7 | 6.2 | 6.5 | 6.7 | 6.9 | 4.7 |
| Catalyst Conversion Byproducts | 1.7 | 1.7 | 1.7 | 1.8 | 1.8 | 1.7 | 1.7 | 1.7 | 1.7 |
| Product Analyses | | | | | | | | | |
| Naphtha | | | | | | | | | |
| % C | 85.62 | 85.49 | 85.70 | 85.82 | 85.75 | 85.49 | 85.81 | 85.82 | 83.24 |
| % H | 13.73 | 13.76 | 13.85 | 14.02 | 14.00 | 14.10 | 14.03 | 13.86 | 12.28 |
| PPM S | — | 19 | 24 | 14 | 24 | 26 | 21 | 23 | 4,800 |
| PPM N | — | 1 | 3 | 10 | 1 | 2 | 2 | 2 | 1,600 |
| PPM O | — | 502 | 373 | 372 | 423 | 383 | 467 | 426 | 38,400 |
| Distillate (above 193° C.) | | | | | | | | | |
| % C | 87.69 | 87.47 | 86.99 | 88.07 | 87.28 | 87.38 | 87.35 | 87.76 | 84.91 |
| % H | 12.11 | 12.48 | 11.99 | 11.67 | 12.58 | 12.62 | 13.38 | 11.78 | 9.44 |
| PPM S | — | 25 | 18 | 17 | 24 | 20 | 30 | 47 | 1,300 |
| PPM N | — | 2 | 31 | 61 | 2 | 2 | 2 | 2 | 7,700 |
| PPM O | — | 416 | 546 | 618 | 429 | 501 | 690 | 933 | 47,500 |
| Distillation Residue | | | | | | | | | |
| % C | | | 65.50 | | | | 63.21 | 56.71 | 63.45 |
| % H | | | 4.38 | | | | 4.30 | 3.38 | 4.25 |
| % S | | | 3.90 | | | | 4.65 | 5.79 | 4.30 |
| % N | | | 1.19 | | | | 1.14 | 1.04 | 1.17 |
| % Ash | 29.56 | 29.63 | 28.31 | 28.43 | 29.15 | 29.62 | 33.39 | 40.21 | 31.50 |
| Fusion Point, °C. | 81 | 82 | 89 | 88 | 97 | 100 | 100 | 94 | 106 |

[a]High temperature separator bottoms

Referring to Table II, Tests 4 through 11 employ both the recycle to extinction step (recycle to extinction of all 590° F.+ distillate by recycle of the vacuum distillate oil) and the vapor phase hydrotreater step of this invention. In all tests, the recycle formulation was managed to completely consume the vacuum distillate oil but there was no recycle of hydrotreater product. Emphasis on the data is on the effect of hydrotreater operating temperature. Test 12 is a base test wherein the same working recipe was used but without passing the oil vapors through the vapor phase hydrogenation reaction. A sub-bituminous coal was used in combination with a relatively lower temperature and long residence time combination in the liquefaction step. A comparison with the bituminous coal vapor phase feed made at other conditions can be made by comparing the results of Test 2 of Table I and Test 12 of Table II. Various combinations of conditions may be used and optimums may change with feedstock oil and inherent catalysis for example. Most sub-bituminous coals will require addition of pyrite to the liquefaction step.

Tests 4 through 11 show the response in the product yield and composition when changes in hydrotreater temperature are imposed. Using the sub-bituminous coal in combination with a larger reactor to increase retention time allows operation at a lower temperature in the liquefaction operation. Tests 10 and 11 show the influence of reactor temperature in the liquefaction operation, allowing comparison at 430° and 440° C. with 420° C. at a constant hydrotreater temperature by comparison with Test 5. The change of feedstock coal in conjunction with altered reactor temperatures of the liquefaction step limit the boiling range of the vapor phase feed stock and hence the boiling range of the vapor phase product. The influence of this temperature can be seen by an increase in the yield of heavy oil in the hydrotreater product and also by a lower yield of non-distillable coal liquid in Test 11 compared to Test 10 or Test 5. The $C_1$ to $C_4$ gas yield increased with conversion of the coal derived material to distillate for the hydrotreater to further convert. Over the range studied the hydrotreater temperature is not very influential in altering the yield of these gases.

The data of Table II show that by proper selection of liquefaction (dissolver) temperature and residence time the yield of $C_1$-$C_4$ gases can be held below 9 or even 8 weight percent, based on moisture-free coal.

The choice of hydrotreater temperature is influenced by observations of the color and storage stability of the products from the hydrotreater, since the better quality products were made at 355° C. or at 385° C. while lower quality products were made at 330° C. or at 340° C. (See Tests 7 and 6). Only at the lower hydrotreater temperatures was the nitrogen removal degraded sufficiently for this residue to become significant in the hydrotreater product. From 355° C. upward the nitrogen content was nearly the same and product quality was nearly the same with regard to storage stability.

An important feature of Tests 4–11 of Table II is that not only is the naphtha yield enhanced as compared to base Test 12, but also the nitrogen level of the naphtha fraction produced in Tests 5, 8, 9, 10, and 11 is 2 parts per million or less. Thereby, the tests embodying the present invention are capable of producing a naphtha fraction of sufficiently low nitrogen level to constitute a suitable reformer feed stock for conversion of high octane gasoline. The reason for the relatively high nitrogen levels in the naphthas of Tests 6 and 7 is that the temperature in the vapor phase hydrotreater was relatively low.

The level of nitrogen removal can be examined in reference to ammonia yield and product composition data. Referring to Table I, ammonia yield from hydrotreating the oil from a bituminous coal essentially doubled (Test 3) compared to the amount made in converting the coal distillate in the conventional SCR II operating mode (Test 2) or compared to the case in which the heavy oil was eliminated by recycle to extinction (Test 1). This observation is supported by the composition of the product oils where nitrogen was reduced from 0.16 percent in the naphtha range to a nil value as determined in a conventional Kjeldahl analysis (and to 0.5 ppm when determined by a more suitable method based on chemiluminescent detection of the nitrogen) for products from bituminous coal. Similar improvement in the nitrogen content of the middle oil and even in the small amount of heavy oil from the hydrotreater product of the bituminous coal is observed.

Referring to Table II, a similar increase in the yield of ammonia from hydrotreatment of the oil derived from a sub-bituminous coal is observed. (Compare Tests 4–11 with Test 12). A more sensitive measure of the improvement is reported in comparison of the nitrogen content of hydrotreater products by comparison to the nitrogen in the products from the base Test 12. Products made with suitable hydrotreater operating temperatures contained no more than 1 or 2 ppm of nitrogen compared to 1,600 ppm and 7,700 ppm in the naphtha and middle distillates in Test 12.

The influence of reactor temperature in the liquefaction part of the process is shown by comparison of Tests 5, 10 and 11 in which the hydrotreater temperature was kept constant and the temperature of the recycle reactor was changed. It can be seen that as liquefaction temperature increased the yield of total oil increased with a corresponding increase in $C_1$–$C_4$ gas yield and with a decline of non-distillable coal liquid yield. With the hydrotreater operating at about the minimum temperature suitable for effective nitrogen removal, it can be seen that changes in the conversion of the organic matter in the sub-bituminous coal to distillate in the liquefaction zone have not greatly influenced the behavior of the hydrotreater. Only by reference to the level of oxygen in the products can it be seen that the increase in temperature has added a more refractory feedstock to the vapor phase. A systematic increase in the residual oxygen in the middle distillate with temperature is observed. The data show that by proper selection of liquefaction temperature, the oxygen content in the 193° C.+ oil product can be held below about 600 or even below about 500 ppm.

These examples show how levels of conversion may be adjusted in the liquefaction zone to deal with various feedstocks and how compensating adjustments in the performance of the hydrotreater may be made when necessary. It is significant that residual heteroatoms and compounds tending to cause product discoloration and gum formation tend to be accumulated in the highest boiling fractions from the hydrotreater. Where it is desired to further refine the product the highest boiling fraction from the hydrotreater can be systematically returned to the feed slurry and can be recycled to extinction together with the vacuum distillate. Since gas yield is increased by an increase in temperature, a preference for operation of the liquefaction step at milder temperatures and at longer retention times is indicated. Another consequence of such operation is the tendency to manufacture a vapor phase which is more amenable to hydrotreating, at least in a sense that lower temperatures in the hydrotreater may be used.

TABLE III

| | Test 13 | Test 14 |
|---|---|---|
| Conditions | | |
| Operating Mode | Recycle to Extinction of 700° F. + Oil With Vapor-Phase Hydrotreater and Recycle to Extinction of Hydrotreater Bottoms | Same, Except Oil From Hydrotreater Not Distilled |
| Coal | Big Brown Lignite | |
| Average Temperature, °C. (°F.) | | |
| Dissolver | 451 (844) | 408 (766) |
| Hydrotreater | 385 (725) | 385 (725) |
| Pressure, psig | 2250 | 2250 |
| Nominal Slurry Residence Time, hr | | |
| Second Stage (dissolver) | 1.01 | 2.00 |
| LHSV in Hydrotreater, $hr^{-1}$ | 0.5 | 0.5 |
| Slurry Formulation, wt % | | |
| Coal | 30.0 | 30.0 |
| Recycled HTSB[d] | 59.2 | 61.2 |
| Recycled Solvent | 10.0 | 8.0 |
| Additive | 0.8 | 0.8 |
| Additive | Pyrite | Pyrite |
| Addition Rate, wt % based on coal | 2.42 | 2.43 |
| Hydrogen Feed Rate | | |
| Wt % based on slurry | 4.16 | 4.08 |
| MSCF/ton of coal | 53.1 | 52.0 |
| Yields, wt % MF Coal | | |
| $H_2O$ | 11.6 | 11.6 |
| $CO + CO_2$ | 4.1 | 3.5 |
| $H_2S$ | 1.6 | 1.6 |
| $NH_3$ | 0.9 | 0.7 |
| Total $C_1$–$C_4$ | 11.1 | 5.5 |
| Naphtha, $C_5$-193° C. (380° F.) | 22.2 | 14.3 |
| Middle Distillate, 193–345° C. (380–653° F.) | 16.5 | 18.8 |
| Heavy Distillate, Above 345° C. (653° F.) but less than 371° C. (700° F.) | 4.8 | 5.6 |
| Total Oil ($C_5$-Heavy Distillate) | 43.5 | 38.7 |
| Non-distillable coal liquid | 16.9 | 26.0 |
| Insoluble Organic Matter | 4.1 | 5.5 |
| Ash | 13.2 | 13.0 |
| Total | 107.0 | 106.1 |
| Hydrogen Consumed | | |
| (by gas balance) | 6.1 | 5.2 |
| (by elemental balance) | 5.9 | 4.9 |
| Catalyst Conversion By-products | 0.9 | 0.9 |
| Product analyses, wt % | | |

TABLE III-continued

| | Test 13 | Test 14 |
|---|---|---|
| Napthaa | | |
| % C | 85.17 | 85.81 |
| % H | 14.04 | 13.90 |
| ppm S | 17 | 33 |
| ppm N | 0.46 | 0.15 |
| ppm O by analysis | 559 | 495 |
| Middle Distillate | | |
| % C | 87.36 | 86.17 |
| % H | 12.39 | 12.42 |
| ppm S | 20 | 34 |
| ppm N | 1.2 | 5.7 |
| ppm O by analysis | 550 | 693 |
| Distillation in Residue | | |
| % C | 50.41 | 59.45 |
| % H | 2.97 | 4.39 |
| % S | 3.09 | 2.95 |
| % N | 1.14 | 1.31 |
| % Ash | 43.09 | 33.04 |
| Fusion Point, °C. | 92 | 93 |

[a]High temperature separator bottoms

Tests 13 and 14 in Table III show the application of the present invention to a lignite feedstock. Test 13 was performed at 451° C. and about a 1 hour residence time in the liquefaction part of the system which generates feedstock to the vapor phase reactor in line. At these conditions, conversion of the non-distillable coal liquid is high and the yield of $C_1$ to $C_4$ hydrocarbons is also high. Thus, the yield of hydrocarbon gases is 11.5 percent and the yield of non-distillable liquid is 16.9 percent. In contrast, Test 14 was performed at 400° C. and 2.0 hours residence time in the liquefaction zone (low temperature-long residence time combination). Here, the yield of $C_1$ to $C_4$ hydrocarbons is lowered remarkably to 5.5 percent while the yield of non-distillable coal liquid was increased to 26.0 percent. A further difference in operating procedure was that the higher temperature conditions of Test 13 required that more oil be returned from the hydrotreater product to feed slurry to maintain the required solids level in the feed slurry than in Test 14. The vapor phase product was therefore redistilled to a cut point of 250° C. to obtain a product and the fraction boiling above 250° C. was returned to feed slurry formulation to obtain the necessary dilution for pumpability. It is noted that non-distillable organic matter is a suitable vehicle for the introduction of coal to the liquefaction step and that operation at the longer residence time lower temperature condition did not convert as much of this material to distillate. Accordingly, the demand for oil to dilute the feed slurry could be satisfied by recycle of the vacuum distillate to extinction with only a minimal transfer of oil from the hydrotreated product. In Test 14 this transfer was accomplished by taking the necessary oil from the atmospheric distillation bottoms (see vessel 94 and line 98). Thus for test 14 the return of oil to feed was only 1/10 of the atmospheric distillation bottoms which accounts to only 0.2% of the feed slurry. On the other hand in Test 13 the return of hydrotreated oil boiling above 250° C. atmospheric pressure amounted to 3.9% of the feed slurry.

In these circumstances the objective was to operate the vapor phase hydrotreater at a constant temperature while investigating the effect of temperature and residence time combinations in the liquefaction zone expected to be operable for a lignite of the type used. The results thus illustrate liquefaction severity on gas yields, conversions of coal to non-distillable coal liquid, and conversions of coal to distillable matter to be further converted in the hydrotreater. To facilitate operation it is necessary in some cases to return some of the hydrotreated oil to the feed slurry, and this can be done without upsetting the performance of the feed slurry, the pumps, or the performance of the liquefaction reaction. Subsequent inspection of products has shown that the method by which this additional oil is returned is of importance, since by distilling the vapor phase product to the cut point required to obtain a balance of residue for return to feed it is possible to return all of the requirement from the distillation residue which contains the highest boiling and most troublesome substances. This limits the amount of such material to be taken as product and disposes of them by recycle to extinction.

With the view that the naphtha from this kind of process would be likely to be used as a reformer stock the products in Tests 13 and 14 were distilled to obtain the naphtha for analysis, and the remaining product was taken as a second cut. The elemental analysis for these fractions is presented. Nitrogen in the naphtha is 0.46 ppm in Test 13 and is only 0.15 ppm in Test 14 naphtha. In the higher boiling fractions nitrogen is 1.2 ppm for Test 13 and 5.7 ppm for Test 14 oil.

Suitable operating conditions for this lignite will likely fall between the temperatures, retention times, and recycle recipes illustrated here. Observation of product colors and storage stability have been correlated with other trace analysis techniques to develop the observation that hydrotreated product may be distilled to select the heavy fraction to allow its return to feed for recycle to extinction, and that formulation strategy and operating conditions should be moderated to allow this as a natural consequence of the operational requirements within the plant. The products from Test 13 have remained water white and stable since their production apparently is a consequence of this formulation strategy.

The low temperature-long residence time strategy of Test 14 resulted in a lower $C_1$–$C_4$ gas yield as compared to Test 13 (5.5 v. 11.1) and a lower hydrogen consumption as compared to Test 13 (5.2 v. 6.1).

I claim:

1. A process comprising liquefying feed coal in a liquefaction zone at liquefaction conditions of temperature, pressure and residence time in the presence of hydrogen with recycle solvent including distillable and non-distillable coal liquids and recycle coal minerals to produce coal liquids, removing a liquefaction zone effluent stream, separating said liquefaction zone effluent stream into an effluent vapor stream and an effluent liquid slurry stream, comprising the hydrocarbons boiling above 700° F., said effluent vapor stream containing naphtha and higher and lower boiling hydrocarbons together with hydrogen, hydrogen sulfide, ammonia, $CO_x$ and water vapor, passing said entire effluent vapor stream through a vapor phase catalytic hydrotreater to hydrotreat said vapor stream, removing distillate liquid from said effluent liquid slurry stream to obtain non-distillable coal liquids and recycling to said liquefaction zone to extinction the 700° F.+ fraction of said distillate liquid, recovering a hydrotreater effluent stream, separating a hydrotreated product oil stream from said hydrotreater effluent stream, said hydrotreated product oil stream comprising substantially the entire distillate oil product of said process.

2. The process of claim 1 wherein said feed coal is bituminous coal.

3. The process of claim 1 wherein said feed coal is sub-bituminous coal.

4. The process of claim 1 wherein said feed coal is lignite.

5. The process of claim 1 wherein said hydrotreater catalyst comprises Group VI-Group VIII metal on a non-cracking support.

6. The process of claim 1 wherein said hydrotreater catalyst comprises Group VI-Group VIII metal on alumina.

7. The process of claim 1 wherein said hydrotreater catalyst comprises nickel-molybdenum-alumina.

8. The process of claim 1 including the addition to said liquefaction zone of pyrite or a material which forms iron sulfide in said liquefaction zone.

9. The process of claim 1 including the additional step of recovering a naphtha stream from said hydrotreated product oil stream.

10. The process of claim 9 wherein said naphtha stream contains less than 2 parts per million of nitrogen.

11. The process of claim 9 including the additional step of passing said naphtha stream to a reformer zone.

12. The process of claim 11 wherein said hydrogen produced in said reformer zone is passed to said liquefaction zone.

13. The process of claim 1 wherein said liquefaction zone effluent stream is cooled before being separated into an effluent vapor stream and an effluent liquid slurry stream.

14. The process of claim 1 wherein said effluent vapor stream is passed through said catalytic hydrotreater without essentially any addition or removal of material therefrom.

15. The process of claim 1 including the additional step of recovering a heavy distillate stream from said hydrotreated product oil stream, and recycling said heavy distillate stream to said liquefaction zone.

16. The process of claim 1 wherein said hydrotreated product oil stream comprises substantially entirely white oil.

17. The process of claim 1 wherein said hydrotreated product oil stream boils substantially entirely below 700° F.

18. The process of claim 1 wherein said hydrotreated product oil stream boils substantially entirely below 600° F.

19. The process of claim 1 wherein said liquefaction pressure is 1,000 to 4,000 psi.

20. The process of claim 1 wherein said hydrotreated product oil stream comprises substantially entirely material in the naphtha, diesel oil and jet fuel boiling ranges.

21. The process of claim 1 wherein the yield of $C_1$-$C_4$ gases is less than 9 weight percent, based on moisture-free feed coal.

22. The process of claim 1 wherein the yield of $C_1$-$C_4$ gases is less than 8 weight percent, based on moisture-free feed coal.

23. The process of claim 1 wherein the oxygen content in the 193° C.+ distillate oil product is below 600 parts per million.

24. The process of claim 1 wherein the oxygen content in the 193° C.+ distillate oil product is below 500 parts per million.

25. The process of claim 1 wherein the oxygen content in the entire distillate oil product is less than 600 parts per million.

26. The process of claim 1 wherein the oxygen content in the entire distillate oil product is less than 500 parts per million.

27. The process of claim 1 wherein the oxygen content in the entire distillate oil product is less than 400 parts per million.

28. The process of claim 1 wherein the nitrogen content in the entire distillate oil product is less than 10 parts per million.

29. The process of claim 1 wherein the nitrogen content in the entire distillate oil product is less than 4 parts per million.

30. The process of claim 1 wherein the sulfur content in the entire distillate oil product is less than 600 parts per million.

31. The process of claim 1 wherein the sulfur content in the entire distillate oil product is less than 400 parts per million.

32. The process of claim 1 including the additional step of recovering a purified water phase from said hydrotreater effluent stream.

33. The process of claim 1 including the addition of an alkaline material to neutralize chlorine that tends to form ammonium chloride in said hydrotreater.

34. The process of claim 1 wherein said step of removing a liquefaction zone effluent stream occurs at essentially said liquefaction pressure.

35. The process of claim 1 wherein said step of passing said entire effluent vapor stream through said catalytic hydrotreater occurs at essentially said liquefaction pressure.

36. A process comprising liquefaction of feed coal in a liquefaction zone at liquefaction temperature, pressure and residence time in the presence of hydrogen with recycle solvent and recycle coal minerals to produce coal liquids, removing a liquefaction zone effluent stream, separating said liquefaction zone effluent stream into an effluent vapor stream and an effluent liquid slurry stream comprising the hydrocarbons boiling above 550° F., said effluent vapor stream containing naphtha and higher and lower boiling hydrocarbons together with hydrogen, hydrogen sulfide, ammonia, $CO_x$ and water vapor, passing said effluent vapor stream through a vapor phase catalytic hydrotreater to hydrotreat said effluent vapor stream, passing said effluent liquid slurry stream to an atmospheric distillation zone to recover an atmospheric distillate and an atmospheric residue slurry, recycling substantially said entire atmospheric distillate and a portion of said atmospheric residue slurry to said liquefaction zone, passing the remaining portion of said atmospheric residue slurry to a vacuum distillation zone to recover a vacuum distillate and a vacuum residue slurry, recycling substantially said entire vacuum distillate to said liquefaction zone, recovering a hydrotreater effluent stream, separating a hydrotreated product oil stream from said hydrotreater effluent stream, said hydrotreated product oil stream comprising substantially the entire distillate oil product of said process.

37. The process of claim 36 including the additional step of passing said vacuum residue slurry to a gasifier zone for the production of hydrogen.

38. The process of claim 36 wherein said step of removing a liquefaction zone effluent stream occurs at essentially said liquefaction pressure.

39. The process of claim 36 wherein said step of passing said effluent vapor stream through said catalytic hydrotreater occurs at essentially said liquefaction pressure.

40. The process of claim 36 wherein said effluent liquid slurry stream comprises the hydrocarbons boiling above 570° F.

41. The process of claim 36 wherein said effluent liquid slurry stream comprises the hydrocarbons boiling above 600° F.

42. The process of claim 36 wherein said effluent liquid slurry stream comprises the hydrocarbons boiling above 700° F.

43. A process comprising liquefying feed coal in a liquefaction zone at liquefaction conditions of temperature, pressure and residence time in the presence of hydrogen with recycle solvent including distillable and non-distillable coal liquids and recycle coal minerals to produce coal liquids, removing a liquefaction zone effluent stream, separating said liquefaction zone effluent stream into an effluent vapor stream and an effluent liquid slurry stream comprising the hydrocarbons boiling above 600° F., said effluent vapor stream containing naphtha and higher and lower boiling hydrocarbons together with hydrogen, hydrogen sulfide, ammonia, $CO_x$ and water vapor, passing said entire effluent vapor stream through a vapor phase catalytic hydrotreater to hydrotreat said vapor stream, removing distillate liquid from said effluent liquid slurry stream to obtain non-distillable coal liquids and recycling to said liquefaction zone to extinction the 600° F.+ fraction of said distillate liquid, recovering a hydrotreater effluent stream, separating a hydrotreated product oil stream from said hydrotreater effluent stream, said hydrotreated product oil stream comprising substantially the entire distillate oil product of said process.

44. A process comprising liquefying feed coal in a liquefaction zone at liquefaction conditions of temperature, pressure and residence time in the presence of hydrogen with recycle solvent including distillable and non-distillable coal liquids and recycle coal minerals to produce coal liquids, removing a liquefaction zone effluent stream, separating said liquefaction zone effluent stream into an effluent vapor stream and an effluent liquid slurry stream comprising the hydrocarbons boiling above 590° F., said effluent vapor stream containing naphtha and higher and lower boiling hydrocarbons together with hydrogen, hydrogen sulfide, ammonia, $CO_x$ and water vapor, passing said entire effluent vapor stream through a vapor phase catalytic hydrotreater to hydrotreat said vapor stream, removing distillate liquid from said effluent liquid slurry stream to obtain non-distillable coal liquids and recycling to said liquefaction zone to extinction the 590° F.+ fraction of said distillate liquid, recovering a hydrotreater effluent stream, separating a hydrotreated product oil stream from said hydrotreater effluent stream, said hydrotreated product oil stream comprising substantially the entire distillate oil product of said process.

45. A process comprising liquefying feed coal in a liquefaction zone at liquefaction conditions of temperature, pressure and residence time in the presence of hydrogen and recycle solvent including distillable and non-distillable coal liquids and recycle coal minerals to produce coal liquids, removing a liquefaction zone effluent stream, separating said liquefaction zone effluent stream into an effluent vapor stream and an effluent liquid slurry stream comprising the hydrocarbons boiling above 570° F., said effluent vapor stream containing naphtha and higher and lower boiling hydrocarbons together with hydrogen, hydrogen sulfide, ammonia and $CO_x$ and water vapor, passing said entire effluent vapor stream through a vapor phase catalytic hydrotreater to hydrotreat said vapor stream, removing distillate liquid from said effluent liquid slurry stream to obtain non-distillable coal liquids and recycling to said liquefaction zone to extinction the 570° F.+ fraction of said distillate liquid, recovering a hydrotreater effluent stream, separating a hydrotreated product oil stream from said hydrotreater effluent stream, said hydrotreated product oil stream comprising substantially the entire distillate oil product of said process.

46. A process comprising liquefying feed coal in a liquefaction zone at liquefaction conditions of temperature pressure and residence time in the presence of hydrogen with recycle solvent including distillable and non-distillable coal liquids and recycle coal minerals to produce coal liquids, removing a liquefaction zone effluent stream, separating said liquefaction zone effluent stream into an effluent vapor stream and an effluent liquid slurry stream comprising the hydrocarbons boiling above 550° F., said effluent vapor stream containing naphtha and higher and lower boiling hydrocarbons together with hydrogen, hydrogen sulfide, ammonia, $CO_x$ and water vapor, passing said entire effluent vapor stream through a vapor phase catalytic hydrotreater to hydrotreat said vapor stream, removing distillate liquid from said effluent liquid slurry stream to obtain non-distillable coal liquids and recycling to said liquefaction zone to extinction the 550° F.+ fraction of said distillate liquid, recovering a hydrotreater effluent stream, separating a hydrotreated product oil stream from said hydrotreater effluent stream, said hydrotreated product oil stream comprising substantially the entire distillate oil product of said process.

* * * * *

UNITED STATES PATENT AND TRADEMARK OFFICE

CERTIFICATE OF CORRECTION

PATENT NO. : 4,569,749

DATED : February 11, 1986

INVENTOR(S) : CHARLES H. WRIGHT

It is certified that error appears in the above-identified patent and that said Letters Patent is hereby corrected as shown below:

Column 1, line 8, change "SCR" to --SRC--.

Column 12, line 68, change "formulations" to --formulation--.

Column 15, line 59, change "oil" to --coal--.

Column 16, Table II-continued, Test 11, under the sub-title Distillation Residue, %N, "1.04" should read --1,02--.

Column 17, line 22, change "SCR" to --SRC--.

Column 19, Table III-continued, the sub-title "Napthaa" should read -- Naphtha --.

Signed and Sealed this

*Fifth* Day of *August 1986*

[SEAL]

*Attest:*

*Attesting Officer*

DONALD J. QUIGG

*Commissioner of Patents and Trademarks*